US005324485A

United States Patent [19]

White

[11] Patent Number: 5,324,485

[45] Date of Patent: Jun. 28, 1994

[54] MICROWAVE APPLICATOR FOR IN-DRUM PROCESSING OF RADIOACTIVE WASTE SLURRY

[75] Inventor: Terry L. White, Oak Ridge, Tenn.

[73] Assignee: Martin Marietta Energy Systems, Inc., Oak Ridge, Tenn.

[21] Appl. No.: 928,412

[22] Filed: Aug. 12, 1992

[51] Int. Cl.[5] ..... G21F 9/30; G21F 9/16; H05B 6/78

[52] U.S. Cl. ..... 422/159; 422/903; 252/628; 219/690; 588/1; 588/19

[58] Field of Search ..... 422/159, 904, 186.3, 422/903; 219/10.55 R, 10.55 F, 10.55 A, 10.55 M; 252/628

[56] References Cited

U.S. PATENT DOCUMENTS

| | | | |
|---|---|---|---|
| 3,006,859 | 10/1961 | Allemann et al. | 252/301.1 |
| 3,773,177 | 11/1973 | Queiser et al. | 210/68 |
| 4,040,973 | 8/1977 | Szivos et al. | 252/301.1 |
| 4,144,186 | 3/1979 | Drobnik et al. | 422/159 |
| 4,221,680 | 9/1980 | Hardwick et al. | 252/301.1 |
| 4,431,164 | 2/1984 | Jungo et al. | 252/628 |
| 4,476,098 | 10/1984 | Nakamori et al. | 422/140 |
| 4,490,287 | 12/1984 | Hardwick et al. | 252/629 |
| 4,514,329 | 4/1985 | Wakabayashi et al. | 252/629 |
| 4,563,335 | 1/1986 | Akiyama et al. | 422/159 X |
| 4,565,670 | 1/1986 | Miyazaki et al. | 422/186.04 |
| 4,620,163 | 10/1986 | Young | 333/21 R |
| 4,631,380 | 12/1986 | Tran | 219/10.55 A |
| 4,710,266 | 12/1987 | Hayashi et al. | 159/7 |
| 4,778,626 | 10/1988 | Ramm et al. | 252/628 |
| 4,844,838 | 7/1989 | Ohtsuka et al. | 252/629 |
| 4,992,217 | 2/1991 | Spinello | 252/628 X |

FOREIGN PATENT DOCUMENTS

| | | |
|---|---|---|
| 62-14098 | 4/1982 | Japan . |
| 1407978 | 3/1980 | United Kingdom . |

OTHER PUBLICATIONS

K. Miyata, J. Ohuchi, E. Inada and N. Tsunoda, Incineration and Ash Melting for Plutonium-Contaminated Combustible Wastes, Ibarkai, Japan.

S. Kowa and H. Genthers, Solidification of Low Level Wastes by Microwave Heating, Heidelberg, Federal Republic of Germany.

D. F. Mielcarek, Werner and Pfleiderer Corp., Twin-Screw Compounding, Ramsey, N.J.

C. B. Goodlett, Wiped-Film Evaporators for Evaporating Alkaline Light Water Reactor Radioactive Wastes, Aiken, S.C.

F. Komatsu, A. Takusagawa, R. Wada & K. Asahina, Application of Microwave Treatment Technology to Radioactive Waste, Kobe, Japan.

*Primary Examiner*—Robert J. Warden
*Assistant Examiner*—E. Leigh Dawson
*Attorney, Agent, or Firm*—Edward A. Pennington; James M. Spicer; Harold W. Adams

[57] ABSTRACT

A microwave applicator for processing of radioactive waste slurry uses a waveguide network which splits an input microwave of $TE_{10}$ rectangular mode to $TE_{01}$ circular mode. A cylindrical body has four openings, each receiving ¼ of the power input. The waveguide network includes a plurality of splitters to effect the ¼ divisions of power.

15 Claims, 4 Drawing Sheets

MICROWAVE APPLICATOR FOR IN-DRUM PROCESSING OF RADIOACTIVE WASTE SLURRY

This invention was made with Government support under contract DE-AC05-840R21400 awarded by the U.S. Department of Energy to Martin Marietta Energy Systems, Inc. and the Government has certain rights in this invention.

FIELD OF THE INVENTION

The present invention relates generally to the treatment of radioactive waste slurries and, more specifically, to an in-drum processing system which utilizes a microwave applicator to heat the wasteform directly and thus provide a volume reduction.

BACKGROUND OF THE INVENTION

Radioactive transuranic liquified wastes produced by nuclear facilities present a difficult problem in terms of storage. Typically, these wastes are stored on site in large stainless steel tanks. Due to the limited capacity of existing storage tanks, industry has sought effective means for reducing the volume of transuranic wastes.

Prior art attempts to effect volume reduction by drying and melting radioactively contaminated slurries have used some what complicated mechanical structures such as "wiped-film evaporators" and "extruders". A wiped-film evaporator is described in a publication entitled "Wiped-Film Evaporators for Evaporating Alkaline Light Water Reactor Radioactive Wastes", by C. B. Goodlett in *Nucl. Tech.*, 43, pp. 259–267, (April, 1979). An extruder is described in a publication entitled "Twin-Screw Compounding" by D. F. Mielcarek in *Chem. Engr. Prog.*, pp. 59–67 (June, 1987). Both types of devices require moving parts and bearings that are prone to wear and corrode when exposed to hot, abrasive, and corrosive chemical slurries. Moreover, both processes require a mechanical process mover to wipe a thin slurry film on an externally heated casing to dry the slurry. Also, some means of conveying the hot slurry is required to prevent build-up in both the wiped-film evaporator and the extruder.

Microwave heating of radioactive wastes has been described in several publications. For example, U.S. Pat. No. 4,514,329 to Wakabayashi et al. describes the treatment of radioactive waste with microwave energy, but the process relates to high temperature vitrification into glass. U.S. Pat. No. 4,563,335 to Akiyama et al. describes a device for concentrating and denitrating a nitrate solution by using microwave energy. However, this reference also requires moving parts to transport the final product and is thus not Hardwick et al. describes a treatment process for high level nuclear wastes in which microwave energy is used to create a glass wasteform.

Other publications that describe other microwave applications to nuclear waste treatment include the following U.S. Pat. Nos.: 4,040,973 to Szivos et al., 4,778,626 to Ramm et al., 4,844,838 to Ohtsuka et al., 4,476,098 to Nakamori et al., and 4,565,670 to Miyazaki et al. In general, these references do not show in-drum processes and thus suffer from requiring moving parts and complex materials handling structures.

SUMMARY OF THE INVENTION

An object of the present invention is to provide a microwave applicator for processing of radioactive waste slurry which is capable of achieving a volume reduction which facilitates handling and storage of the waste slurry.

Another object of the present invention is to provide a microwave applicator for processing of radioactive waste slurry which immobilizes remote-handled, transuranic liquids and solids by forming a solid monolith from melted salt residues.

Another object of the present invention is to provide a waveguide for a microwave heating apparatus which is capable of generating $TE_{01}$ circular mode microwave energy.

These and other objects of the invention are met by providing a microwave applicator for processing of radioactive waste slurry which includes a body having an open lower end positionable over a waste container, a slurry inlet disposed in the body, and waveguide means, coupled to a microwave power source, for introducing $TE_{01}$ circular mode microwave energy into the body at a level sufficient to heat and thus solidify slurry exiting the slurry inlet.

Other objects, advantages and salient features of the invention will become apparent from the following detailed description, which, taken in conjunction with the annexed drawings, discloses preferred embodiments of the invention.

DETAILED DESCRIPTION OF THE PREFERRED EMBODIMENTS

Figure 1:
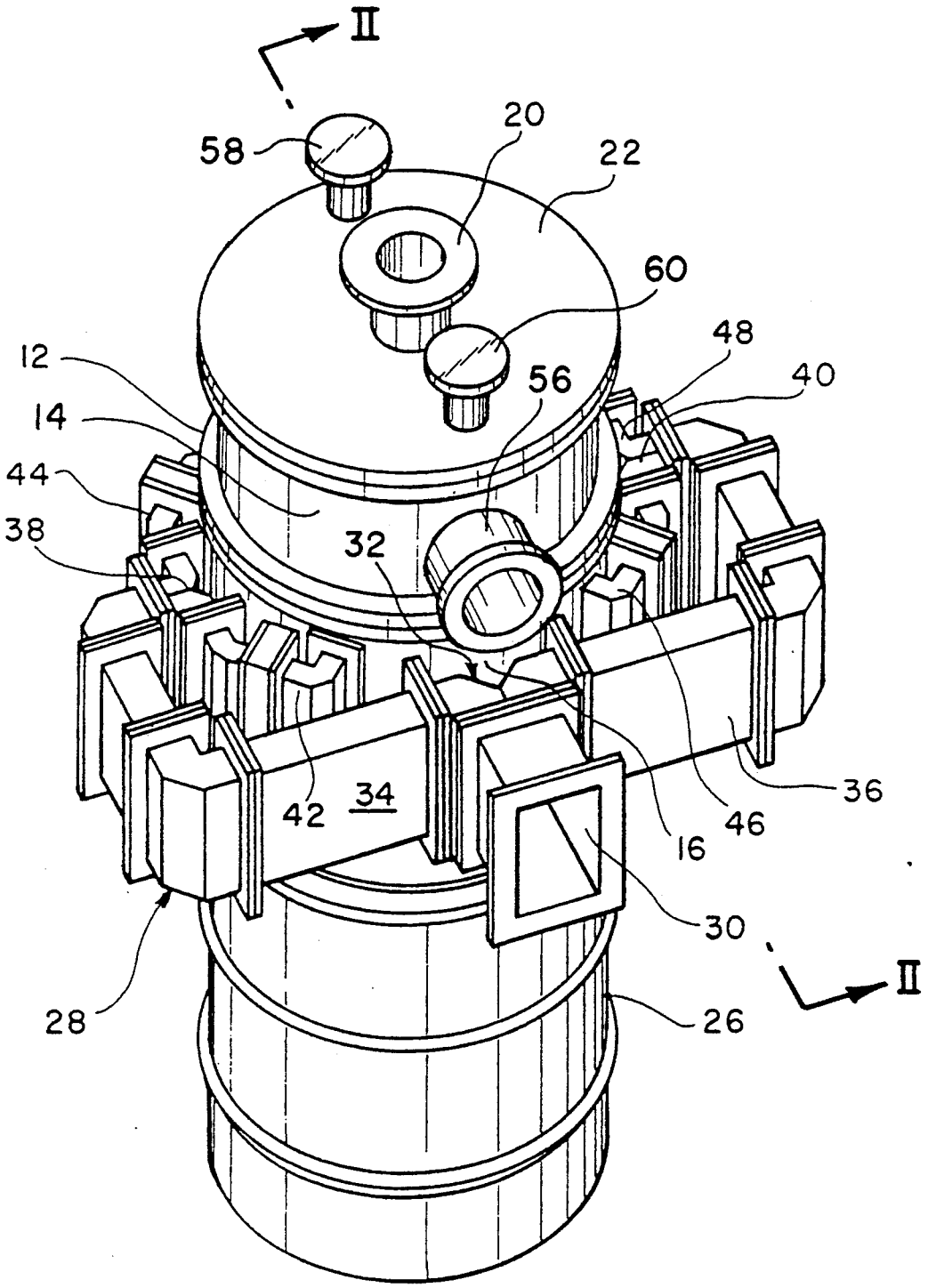
FIG. 1 is a perspective view of a microwave applicator for in-drum processing of radioactive waste slurry according to a preferred embodiment of the present invention.
Figure 2:
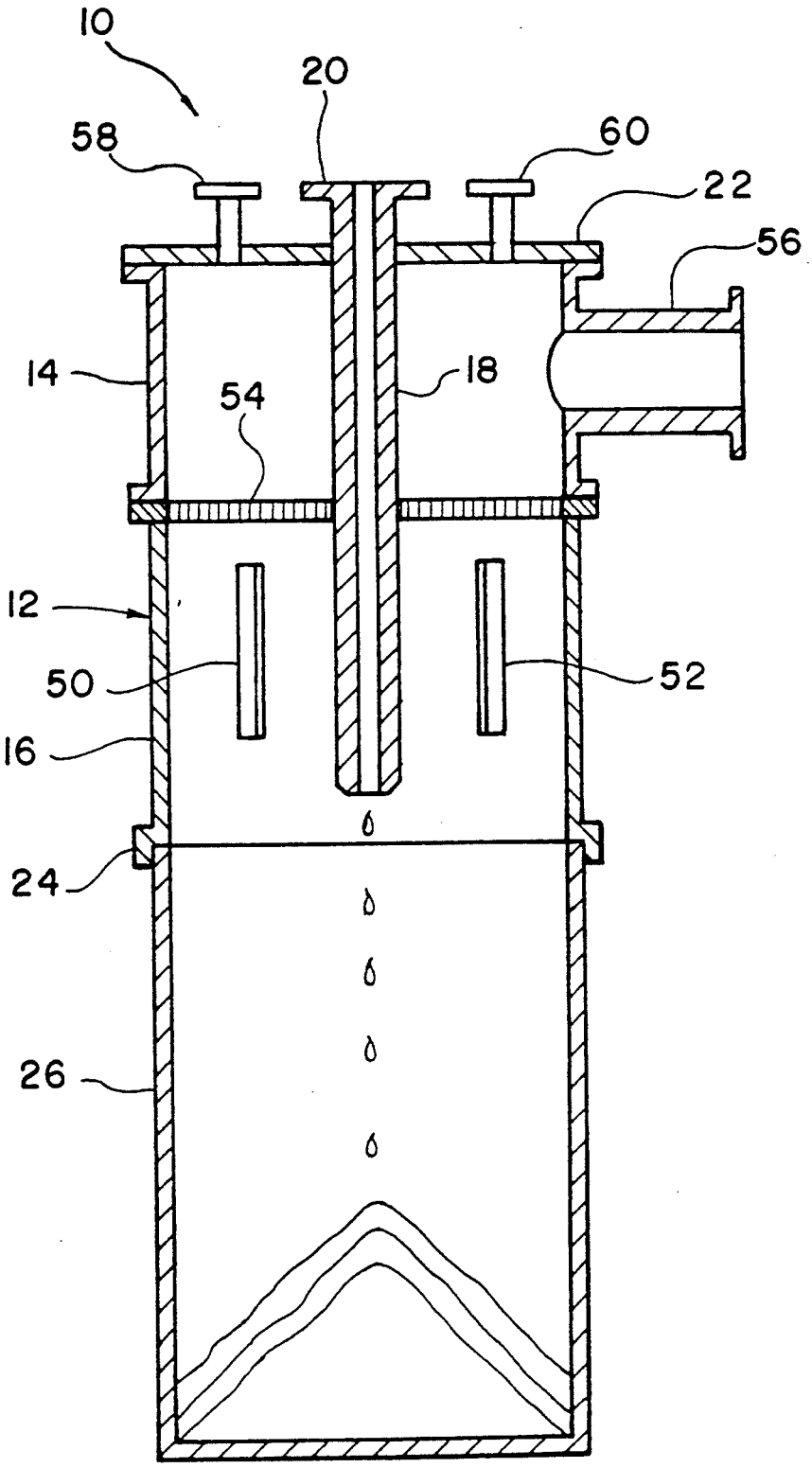
FIG. 2 is a sectional view taken along line II—II of FIG. 1 with the waveguide network removed for purposes of illustration.

Referring now to FIGS. 1 and 2, a microwave applicator 10 includes a cylindrical body 12 which is defined by an upper cylindrical sleeve 14 coupled to a lower cylindrical sleeve 16. A center conductor 18 is mounted to extend coaxially through the upper and lower sleeves 14 and 16, and serves as the slurry inlet. The upper end 20 of the center conductor 18 extends through an upper end plate 22 of the upper sleeve 14 and is to be coupled to a supply (not shown) of radioactive waste slurry. These slurries may contain those of a class known as "remote-handled transuranic" (RH-TRU), which predominately include NaNO3, with the balance of solids consisting of NaCl, $KNO_3$, $Fe_2O_3$, $CaCO_3$, clay, and Hydroxides of Ca, Mg, and Na.

The open lower end 24 of the lower sleeve 16 is sized to fit over the open end of a fifty-five (55) gallon drum liner 26 (typically 23 inches in diameter) which receives the liquid slurry. Microwave energy dries the liquid slurry and forms a nitrate salt residue. The resulting nitrate salt residues are subsequently melted. Upon cooling, the molten salt residue forms a solid monolith which is acceptable for storage.

A waveguide 28, connectable to a microwave power source (not shown), produces $TE_{01}$ circular electric mode microwave energy. The input microwave energy of $TE_{10}$ rectangular mode at the waveguide inlet 30 is divided into two equal parts by a first splitter 32 which forms two branch conduits 34 and 36. Second and third splitters 38 and 40 are disposed respectively at the ends of the branch conduits 34 and 36 to further divide the microwave energy into a total of four equal parts. Each of the splitters 38 and 40 form two additional branch conduits 42, 44 and 46, 48 which terminate in four rectangular openings formed in the lower cylinder 16. Two of the openings 50 and 52 can be seen in FIG. 2. The openings are spaced at 90° intervals. The height of each opening is the same as the height of the inlet 30, but the width is ¼ that of the inlet. In a preferred embodiment, the inlet 30 has a height of 9.75 inches and a width of 4.875 inches. Generally, the inlet width is ½ the height.

The dominant mode $TE_{10}$ rectangular mode microwave power enters the waveguide network and is at first split into two equal parts. These two parts are further split by the second and third splitters so that the microwave energy is divided into four equal parts, which are then fed in phase into the body 12 through the four openings. The phase of each of the four slots is identical due to the equal paths from input 30 to each of the four openings. These in-phase field components are equal in amplitude and phase and preferentially excite the $TE_{01}$ circular electric mode that is used for heating the waste in the drum liner 26.

Figure 3:
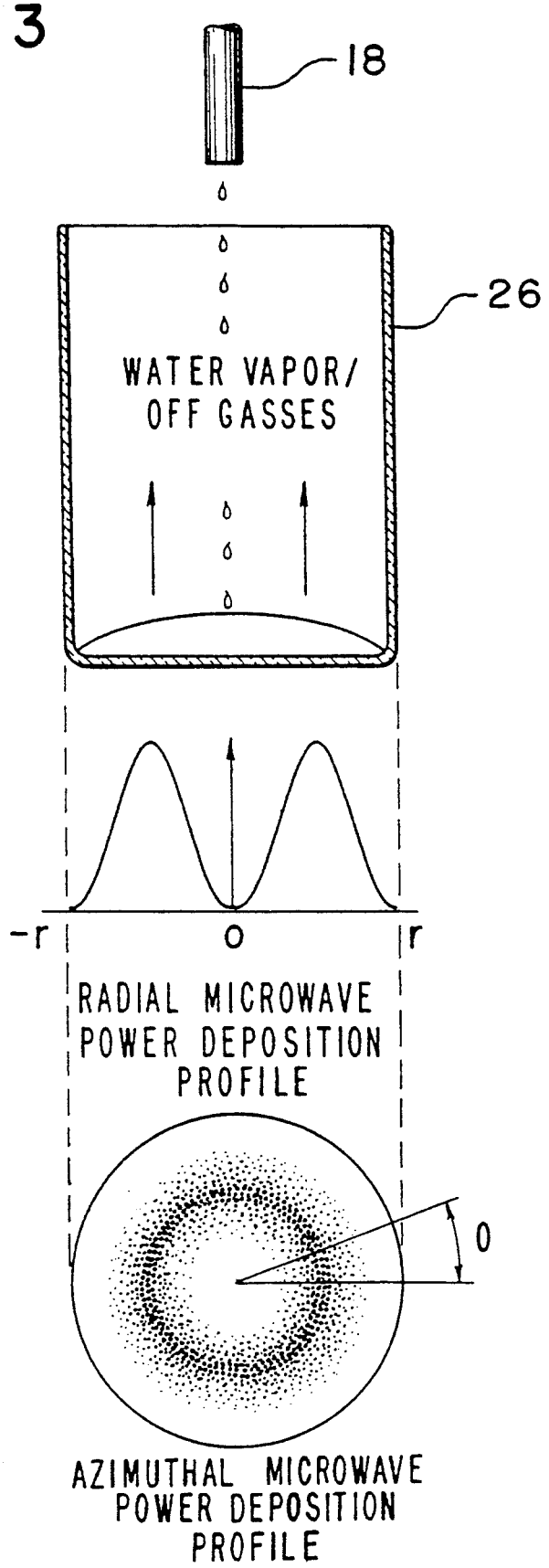
FIG. 3 is a schematic view showing radial power distribution achieved with the circular electric mode microwave according to the present invention.

As sludge spreads out along the bottom of the drum liner 26, it is exposed to an increasing radial power density roughly halfway between the center and edge of the drum liner, as seen in FIG. 3. The power density is constant in azimuthal angle. The gradient in radial heating rate has the potential to allow for continuous processing of the slurry. As shown in FIG. 3, the $TE_{01}$ microwave energy has a null or near zero energy level at the inner cylindrical surface of the body and at the outer cylindrical surface of the center conductor 18. This prevents arcing at these surfaces.

As the slurry is heated, water vapor and off gasses are generated. These rise to pass through a wire screen 54 fixedly disposed between the upper sleeve 14 and the lower sleeve 16, and are evacuated from the upper cylinder 14 by a port 56. The screen 54, which is made of conducting material, also confines the microwave energy to the area below the screen.

Placing the microwave input openings on the side facilitates the removal of off gasses and water vapor from above, and makes it less likely for these to enter the waveguide network. Moreover, the upper end plate 22 can be provided with inspection ports 58 and 60 to permit, for example, television camera viewing and infrared sensing of the heating process.

It is possible to create the requisite $TE_{01}$ circular mode with fewer than four openings if smaller containers are to be used. For example, a two-opening waveguide system could be used with the openings spaced at 180° intervals for use with ten (10) gallon drums.

Figure 4:
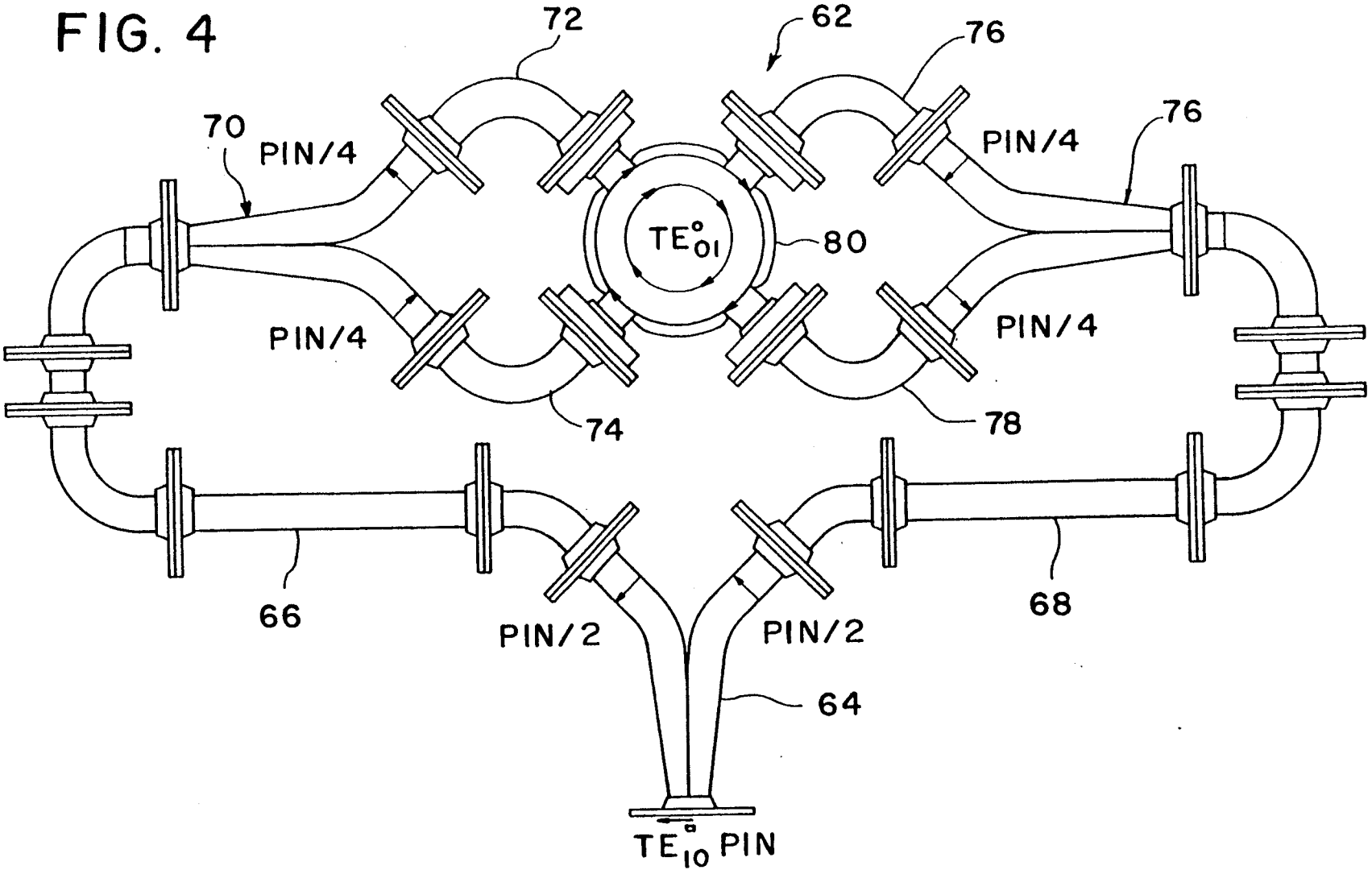
FIG. 4 is a schematic view of a microwave guide of another embodiment of the present invention.

An alternative waveguide network 62 is shown in FIG. 4. The network includes a first splitter 64 which divides the input microwave energy Pin into two equal parts Pin/2, which travels along the two conduits 66 and 68. A second splitter divides the microwave energy Pin/2 into two equal parts Pin/4, which travels along conduits 72 and 74. Similarly, a third splitter 76 divides the microwave energy Pin/2 in conduit 68 into two equal parts Pin/4, which then travel through conduits 76 and 78. Four openings provided at 90° intervals in the body 80 feed the microwave energy into the body in phase. These in-phase field components are equal in amplitude and preferentially excite the $TE_{01}$ circular electric mode that is used for heating the waste in the drum. This embodiment has less acutely angled divisions of the conduit and can be used where there are fewer limitations on space.

The splitters described in the two embodiments are of relatively simple construction and only require an axially located, central knife plate where the conduit forks where necessary to create the four equal parts.

The power source for coupling to the waveguide and providing the necessary microwave energy is preferably a 60 kW, 915 MHz generator. This frequency level is lower than what has been used in other microwave heating processes, and thus will provide the additional advantage of lower operating costs due to the lower frequency level.

While advantageous embodiments have been chosen to illustrate the invention, it will be understood by those skilled in the art that various changes and modifications can be made therein without departing from the scope of the invention as defined in the appended claims.

What is claimed is:

1. A microwave applicator for processing of radioactive waste slurry, comprising:

a body having an interior and an open lower end positionable over a waste container, a slurry inlet extending coaxially into the body; and waveguide means, connectable to a microwave power source and being in communication with the interior of the body through at least two openings formed in the body, for introducing $TE_{01}$ circular mode microwave energy into the body at a level sufficient to heat and thus solidify slurry exiting the slurry inlet.

2. A microwave applicator according to claim 1, wherein the body is a vertically oriented cylinder and has an upper portion and a lower portion, and the slurry inlet is a cylindrical center conduit mounted to extend coaxially through the upper and lower portions of the body, said lower portion of the body having a cylindrical inner surface, and said center conduit having an outer cylindrical surface, said $TE_{01}$ circular mode microwave energy having a substantially null energy level at the outer surface of the center conduit and the inner surface of the lower portion of the body.

3. A microwave applicator according to claim 2, wherein the body has an upper end plate, and the center conduit has an upper end which extends through the upper end plate.

4. A microwave applicator according to claim 2, further comprising a wire screen disposed transversely in the body and separating the upper portion of the body from the lower portion.

5. A microwave applicator according to claim 4, wherein the body has an upper end plate, and the center conduit passes through the end plate microwave.

6. A microwave applicator according to claim 5, further comprising port means, disposed in the upper end plate of the body, for permitting inspection of an interior of the body during microwave.

7. A microwave applicator according to claim 2, further comprising outlet means, disposed in the upper portion of the body, for removing water vapor and off gasses produced during microwave heating of the slurry.

8. A microwave applicator according to claim 1, wherein the waveguide means includes a rectangular waveguide inlet conduit, a first splitter dividing the inlet conduit into first and second branch conduits, second and third splitters disposed respectively at ends of the first and second branch conduits to form third, fourth, fifth, and sixth branch conduits which are respectively coupled to four openings formed at 90° intervals around the circumference of the body.

9. A microwave heating apparatus comprising:

a vertically oriented body having a cylindrical interior chamber, a closed upper end, and an open lower end positionable over a waste container;

a center conduit extending coaxially within the body from the upper end, the center conduit being hollow and having open opposite ends; and waveguide means, connectable to a microwave power source, and being in communication with the interior chamber of the body through at least two openings formed in the body, for introducing $TE_{01}$ circular mode microwave energy into the body at a level sufficient to heat and thus solidify slurry exiting the center conduit; and outlet means, disposed near the closed upper end of the body, for removing gasses produced during microwave heating.

10. A microwave heating apparatus according to claim 9, wherein the waveguide means has a rectangular inlet which receives $TE_{10}$ rectangular mode microwave input energy from the source.

11. A microwave heating apparatus according to claim 10, further comprising a plurality of equidistantly spaced openings formed in the body, and the waveguide means includes means for delivering the input energy in equal divisions to the plurality of openings.

12. A microwave heating apparatus according to claim 11, wherein the waveguide means comprises a rectangular waveguide inlet conduit, a first splitter dividing the inlet conduit into first and second branch conduits, second and third splitters disposed respectively at ends of the first and second branch conduits to form third, and fourth, fifth, and sixth branch conduits which are coupled respectively to four openings formed at 90° intervals around the circumference of the body.

13. A microwave heating apparatus according to claim 12, further comprising a wire screen disposed transversely in the body and separating the body into an upper portion and a lower portion.

14. A microwave heating apparatus according to claim 13, wherein the body includes an upper end plate and the center conduit passes through the upper end plate.

15. A microwave heating apparatus according to claim 14, further comprising port means, disposed in the upper end plate of the body, for permitting inspection of an interior of the body during microwave.

* * * * *